US005297640A

United States Patent [19]

Jones

[11] Patent Number: 5,297,640

[45] Date of Patent: Mar. 29, 1994

[54] DRILL COLLAR FOR USE IN HORIZONTAL DRILLING

[76] Inventor: Tom Jones, 4608 Greentree Blvd., Midland, Tex. 79707

[21] Appl. No.: 968,582

[22] Filed: Oct. 29, 1992

[51] Int. Cl.[5] ..... E21B 7/08

[52] U.S. Cl. ..... 175/73

[58] Field of Search ..... 175/73, 74, 61, 62, 175/79, 320, 321, 325.1, 325.2

[56] References Cited

U.S. PATENT DOCUMENTS

| | | | |
|---|---|---|---|
| 2,263,579 | 11/1941 | Hokanson . | |
| 2,330,564 | 9/1943 | Dyer . | |
| 3,067,593 | 12/1962 | McCool . | |
| 3,145,785 | 8/1964 | Kellner | 175/73 |
| 3,175,374 | 3/1965 | Toelke . | |
| 3,237,427 | 3/1966 | Scarborough . | |
| 3,338,069 | 8/1967 | Ortloff . | |
| 3,525,237 | 8/1970 | Lari . | |
| 4,378,057 | 3/1983 | O'Connell . | |
| 4,465,147 | 8/1984 | Feenstra et al. | 175/73 |
| 4,938,299 | 7/1990 | Jelsma | 175/73 |

*Primary Examiner*—Thuy M. Bui
*Attorney, Agent, or Firm*—Head & Johnson

[57] ABSTRACT

An improved drilling drill collar particularly for use in drilling horizontal wells employing a fluid driven drill, the drill collar being in the form of an elongated intermediate portion of at least substantially triangular cross-sectional configuration and having a central passageway therethrough and having externally threaded ends, the intermediate portion being formed of a lightweight metal, such as aluminum, magnesium or alloys therefore, a first tubular tool joint member threadably secured to the intermediate portion first end and a second tubular tool joint member threadably secured to the intermediate portion second end, one of the tool joint members having female threads and the other external threads so that thereby joints may be threadably secured end-to-end, the tool joint members being of a stronger metal, such as steel, the triangular configuration of the drill collar permitting free flow of well drilling circulation fluid as the drill collar lies in a horizontal borehole.

2 Claims, 1 Drawing Sheet

DRILL COLLAR FOR USE IN HORIZONTAL DRILLING

BACKGROUND OF THE INVENTION

1. Field Of The Invention

Oil and gas wells are typically drilled in a generally vertical orientation, that is, a borehole extends from the earth's surface generally vertically to penetrate oil and gas bearing subterranean formations. In recent years renewed interest has developed in the enhancement of oil or gas producing capabilities of a borehole by drilling the lower portion thereof generally horizontally. In some formations production can be dramatically improved by extending the well horizontally in the formation, exposing the borehole to the proximity of a greater portion of the formation than is possible with vertical drilling.

In vertical drilling the weight of the drill string, which is made up of a sequence of drill collars threadably secured to each other, augments the drilling efforts. Drilling is usually accomplished by rotating a drill string to, in turn, rotate a drill bit at the bottom of the drill string. The weight of the drill collars, particularly those immediately above the bit, is used to apply drilling pressure of the bit against the formation being drilled. Accordingly, in the usual practive of vertically drilling oil and gas wells the weight of the drill string is not normally a limiting factor and, in fact, the weight of the drill string is used advantageously. However, when a hole extends horizontally the weight of the drill collars in the horizontal portion is of no advantage. The typical horizontally bored oil or gas well extends generally vertically for a major portion of the borehole length. As the borehole approaches the producing formation, the borehole is slanted and is converted into a bend or turn in the borehole that can be as much as 90 degrees, the portion of the borehole after the turn being substantially horizontal. A problem with drilling horizontal boreholes is the fact that the drill string must be pushed horizontally as the borehole advances. Thus, increased weight of the drill collars is a disadvantage.

Another problem encountered in drilling horizontal boreholes is that rotary drill strings cannot be effectively employed. For this reason, the typical means of drilling horizontally in a borehole is to use what is known as "turbine drill"—that is, a drilling system employing a motor producing rotational torque in response to fluid flow therethrough, the rotational torque being applied to a drill bit. Turbine drilling requires a fairly high flow rate of drilling fluid. The drilling fluid serves three main purposes. First, the flow of the drilling fluid through the interior of the drill string and out through the turbine provides the rotational torque for rotating the drill bit. Second, the circulating drilling fluid serves to carry away cuttings produced by the drill bit that must be carried back to the earth's surface to leave the drilled hole open. Third, the circulating drilling fluid serves to cool the bit as it works against the formation being drilled.

A serious problem encountered with the use of the typical cylindrical drill strings made up of a sequence of lengths of cylindrical drill collars is that of preventing the drill collar from becoming stuck in the horizontal portion of the borehole. As a cylindrical drill collar lies horizontally in a borehole in a non-rotating position the cuttings produced by the turbine rotating drill bit tend to settle and collect around the cylindrical drill collar in the area between the drill collar and the interior of the horizontal borehole. If sufficient cuttings settle and compact in this manner the drill string can be stuck so that it cannot be pulled out of or retrieved from the borehole.

In object of this invention is to provide an improved drill collar for use in drilling a horizontal borehole and to eliminate the cronic problem of rotating the drilling string from surface to bit.

2. Related Background Art

Others have given consideration to the desirability of improved drill collars. U.S. Pat. No. 3,525,237 to Lari entitled "Drill-Stem", issued Aug. 25, 1970, shows an integral drill collar with a generally rectangular configuration. The drill collar is of a unitary construction, that is, the threaded end portions and the intermediate portion are of the same material and the exterior configuration is somewhat triangular but more in the shape of a curved equilateral triangle, with equal axial moments of inertia as to every axis that passes through the center of the base circle of the cross-section of the triangle. Lari provides a drill collar that is non-circular in cross-section but wherein the cross-section does not have the advantages of a distinct triangular shape so as to allow, as the drill collar lies in the horizontal borehole, free fluid flow passages between the exterior of the drill collar and the cylindrical borehole. Further, Lari provides a drill collar of a unified construction so that all portions thereof must be of a material having sufficient strength to accept threads so that drill collars can be joined together.

U.S. Pat. No. 3,237,427 to Scarborough entitled "Drill Collar", issued Mar. 1, 1966, shows a drill collar in which the cross-section thereof is rectangular. The rectangular configuration is an improvement over a cylindrical drill collar if used for horizontal drilling but still does not supply adequate areas of fluid circulation in the annular space between the exterior of the drill collar and the interior cylindrical borehole. Further, Scarborough, like Lair, is of a unified construction and thus not susceptible of being formed of lightweight material.

Other patents that show drill collars of various constructions are the following:

| | | | |
|---|---|---|---|
| 2,263,579 | Hokanson | Sectional Drill Rod | Nov 25, 1941 |
| 2,330,564 | Dyer | Mud Ejection Control | Sep 28, 1943 |
| 3,067,593 | McCool | Integral Tool Joint Drill Pipe | Dec 11, 1962 |
| 3,175,374 | Toelke | Tubular Member For Use In Well Drilling Operations | Mar 30, 1965 |
| 3,237,427 | Scarborough | Drill Collar | Mar 01, 1963 |
| 3,338,069 | Ortloff | Rotary Drill Collar | Aug 29, 1967 |
| 3,525,237 | Lari | Drill-Stem | Aug 25, 1970 |
| 4,378,057 | O'Connell | Coupling Structure For A Compound Drill Stem | Mar 29, 1983 |

These patents are representative of the state of the art of drill collars as used in drilling oil or gas wells.

SUMMARY OF THE INVENTION

This invention provides an improved drill collar that is particularly useful in drilling a horizontal portion of an oil or gas well borehole. A drill string is made up of a length of drill collars that are threadably coupled end-to-end. The drill collar of this invention is particularly useful for the horizontal portion of a drill string, that is, that portion of the drill string that is adjacent a turbine drill bit employed for drilling a horizontal borehole.

The drill collar of this invention includes an elongated intermediate portion, typically about 31 feet in length. The intermediate portion has a triangular cross-sectional configuration and a central passageway therethrough. The typical dimension in cross-section of the drill collar from the axis of the central passageway to the apex of the triangular cross-sectional configuration is about 4 inches. The elongated intermediate portion of the drill collar is preferably formed of a lightweight metal such as aluminum, magnesium, or alloys thereof.

The elongated intermediate portion has a first and second end, each end being externally threaded, such as with an Acme thread but the thread can be of another type. In a most preferred arrangement, the drill collar has a short-length cylindrical portion adjacent one of the threaded ends providing an area for the attachment of slips or elevators as employed in running the drill collars into and out of a borehole.

A first tubular tool joint has an internally threaded portion at each end. The first threaded end being secured to the drill collar intermediate portion first end and the other end of the tool joint being internally threaded.

A second tubular tool joint has one end that is internally threaded and is received on the intermediate portion second end. The other end of the second tool joint has an external thread matching the internal thread of the second end of the first tool joint. The tubular tool joints are formed of a metal that is superior in strength to that of the intermediate portion and are preferably made such as steel or steel alloys. The tubular tool joints are securely threadably affixed to the opposed ends of the drill collar and remain with the intermediate portion so that the elongated intermediate portion and the first and second tubular tool joints together form a drill collar.

When the drill collar is lying in a horizontal borehole its cross-sectional external configuration forms relatively large fluid flow areas between the exterior of the drill collar and the borehole. This means that drilling fluid can turbulent flow in the annular area between the exterior of the drill collar and the borehole. Further, the cross-sectional configuration provides relatively small contact areas between the exterior of the drill collar and the borehole so that it can be more easily moved horizontally to thereby reduce the possibility of the drill collar becoming stuck in the borehole.

DESCRIPTION OF THE DRAWINGS

FIG. 1 shows the drill collar intermediate portion cut away to show the first and second ends. First and second tubular tool joint members are shown in cross-section affixed to the drill collar intermediate portion.

FIG. 4 illustrates, as an example, four drill collars showing that the triangular cross-section drill collar intermediate portions align in a random pattern to create varying flow passageways in the annular area between the exterior of the drill collar intermediate portions and the borehole. This tubular fluid flow helps keep the borehole clear and reduces the possibility of the horizontally positioned drill collars from being stuck in the borehole.

DESCRIPTION OF THE PREFERRED EMBODIMENTS

Figure 2:
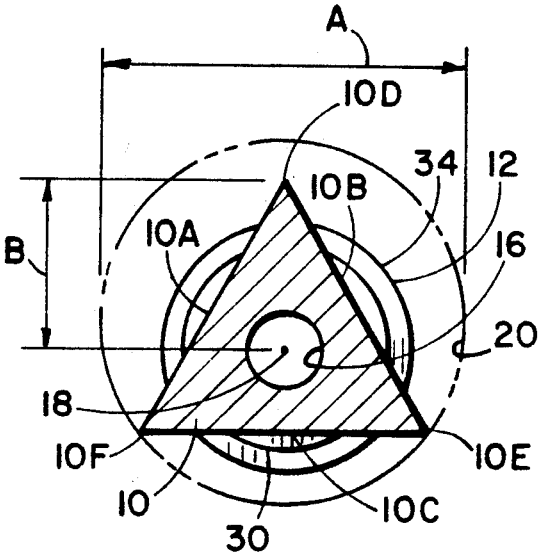
FIG. 2 is a cross-sectional view taken along the line 2—2 of FIG. 1 showing also the outline of a borehole in which the drill collar is positioned.
Figure 1:
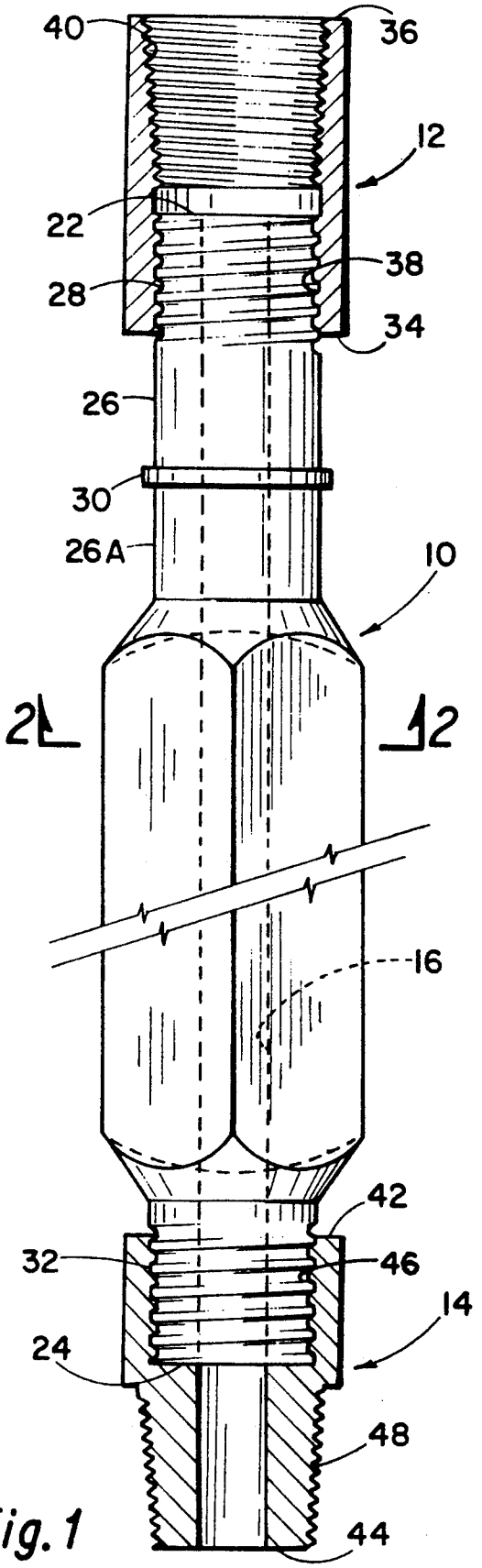
FIG. 1 is a fragmentary elevational view of an improved drill collar for use in drilling horizontal boreholes.

Referring to FIGS. 1 and 2, the improved drill collar for use in horizontal drilling is illustrated in a preferred arrangement. The drill collar includes basically an elongated intermediate portion, generally indicated by the numeral 10, a first tubular tool joint member, generally indicated by the numberal 12, and a second tubular tool joint member, generally indicated by the numeral 14.

The intermediate portion 10 is shown broken away in the middle since it is a relatively long portion, typically about 31 feet in length. As shown in FIG. 2, the intermediate portion is of triangular cross-sectional configuration and has a central fluid passageway 16. The intermediate portion has an elongated central axis 18. A typical borehole size of an oil or gas well is 8½ inches. The borehole 20, as shown in dotted outline in FIG. 2, has typically a diameter "A" of 8½ inches. The cross-sectional dimensions of the intermediate portion 10 provides a radius "B", typically of 4 inches. The importance of these dimensions and the relationships thereof will be discussed subsequently.

Intermediate portion 10 has a first end 22 and a second end 24. The portion adjacent the first end 22, indicated by the numeral 26, is cylindrical and is provided with external threads 28. Threads 28 may be such as Acme threads, although the invention is not limited specifically to the use of Acme threads.

The cylindrical portion 26 is further illustrated as having a circumferential bead 30 thereon. The purpose of bead 30 is to divide the cylindrical portion 26 into a zip groove, that is, a cylindrical area adapted to receive an elevator, and a slip groove, that portion indicated by the numeral 26A that is adapted to receive slips as employed when threading sequential lengths of drill collars to each other or unthreading lengths of drill collars from each other as the drill string is run into or removed from a borehole.

The intermediate portion 10 second end 24 is provided with external threads 32 that may be the same as threads 28 that are preferably but not limited to Acme type threads.

First tubular tool joint member 12 has a first end 34. Internal threads 38 at the first end are matched to the intermediate portion external threads 28. The tubular tool joint member 12 is threadably secured to and in normal applications remains permanently affixed to the drill collar intermediate portion 10.

Internal threads 40 are provided in the second end 36 of the first tubular tool joint member 12. Threads 40 are typically 4½ inch IF as typically employed as a female thread on the usual drill string drill collar by which lengths of drill collars making up a drill string are connected end-to-end.

Second tubular tool joint member 14 has a first end 42 and a second end 44. At first end 42 internal threads 46 are provided to match the intermediate portion external threads 32. Since the tubular tool joint members 12 and 14 are intended to remain permanently with the drill collar intermediate portion during normal usage threads 32 and 34 are preferably of the type that are not easily unthreaded and, therefore, Acme threads are desirable but the invention is not limited to Acme threads. Other means may be provided to maintain the more or less permanent connection of the tubular tool joint members 12 and 14 to the intermediate portion.

At the second tubular tool joint member second end 44, external threads 48 are provided that are of the type that match the first tool joint member internal threads 40 so that successive lengths of drill collars can be secured end-to-end.

The intermediate portion of drill collar 10 is preferably formed of lightweight material, such as aluminum, magnesium or alloys thereof. The advantage of lightweight material is that the drill collars are easier to push into or pull out of a horizontally drilled borehole, and the reduced weight thereof also reduces the possibility of the drill collar becoming stuck in the horizontal portion of a borehole. The tubular tool joints 12 and 14 however are preferably made of a much stronger metal, such as steel or alloys thereof, since the tool joint members must be threaded and unthreaded from each other in the process of running drill strings into and out of a borehole.

Referring to FIG. 2, the advantages of employing a lightweight drill collar having a triangular cross-sectional external configuration can be seen. The triangular shape, in cross-section, provides three sides 10A, 10B and 10C and three apexes 10D, 10E, and 10F at the intersection of the sides. The sides intersect at an apex such as 10D at an angle of 60 degrees. Thus as shown in FIG. 2, apexes 10E and 10F touch the wall of borehole 20 at relatively sharp angles so that large spaces are provided on all three sides of the drill string between the exterior of the drill collar and borehole 20 to allow ample area for the flow of circulation fluid and to thereby diminish the possibility of cuttings settling around the drill string and entrapping it within the borehole. Further, it can be seen that with only two points of contact (as viewed in cross-section, the points 10E and 10F of FIG. 2) between the exterior of the drill collar and the borehole means that the frictional engagement of the drill collar with the borehole is substantially minimized compared to a cylindrical drill collar to thereby make it easier to move the drill collar within a horizontal borehole, whether the movement is in the direction to advance the bit or to withdraw the drill string from the borehole. Further, the use of lightweight material, such as aluminum, magnesium, or alloys thereof, means that the weight of the drill collar bearing against the borehole is substantially reduced, making it easier to move the drill collar in a horizontal borehole.

Figure 3:
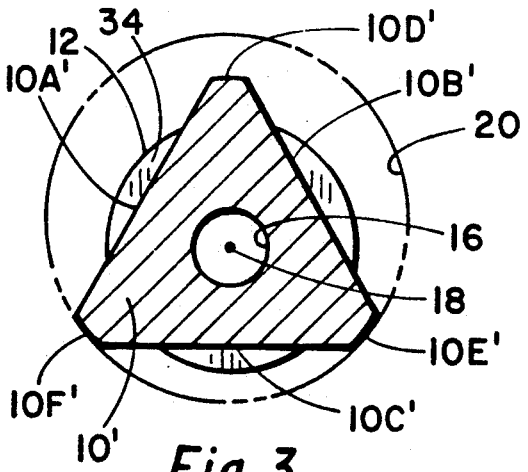
FIG. 3 is a cross-sectional view as in FIG. 2 but showing a slightly alternate embodiment of the invention wherein, in cross-section, the drill collar intermediate portion is triangular but has, at the apexes, short-length radius surfaces, the radius being approximately that of the diameter of the borehole in which the drill string is to be used.

FIG. 3 shows a slightly alternate embodiment of the cross-sectional configuration of the drill collar intermediate portion designated as 10'. The intermediate portion is triangular as in FIG. 2 but is modified at the apexes of the triangle, that is, at 10D', 10E' and 10F'. The apexes, as shown in FIG. 3, are provided with short-length radiuses. The radius of each of the apexes 10D', 10E' and 10F' is preferably the radius of borehole 20 in which the drill collar is to be employed. By providing short-length radiuses at each apex the possibility of the penetration of the drill collar intermediate portion edges into the borehole wall is reduced while, at the same time, maintaining the flow passageways surrounding the drill collar.

Figure 4:
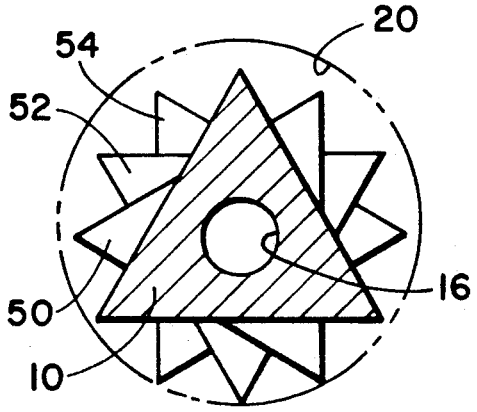
FIG. 4 is a cross-sectional view as in FIG. 2 but showing the results of a sequence of lengths of drill collars lying in a borehole.

One important advantage of the improved drill collar of this invention for use in drilling horizontal boreholes is illustrated in FIG. 4. Drill collars are typically about 31 feet in length. Thus, to drill 1000 feet of horizontal borehole approximately 32 drill collars would be required, secured sequentially to each other end-to-end. In the process of securing the drill collars end-to-end the triangular cross-sectional configuration of adjacent drill collars will not align with each other due to typical manufacturing tolerances in the threaded components and the torque that is employed in the threadably coupling sequential drill collars to each other. Further, if the cross-sectional configurations of a sequence of drill collars extending horizontally and viewed in a vertical plane is such that the collars tend to align, then the installation should be carried out in such a way as to ensure that the cross-sectional configurations of sequential drill collars preferably do not align. As seen in FIG. 4, five successive drill collars are shown in end-to-end arrangement. Only the external configuration of the intermediate portions are illustrated in FIG. 4. The four drill collar intermediate portions are designated as 10, 50, 52, and 54. As previously indicated, if the horizontal borehole 20 is approximately 1000 feet, approximately 32 drill collars would be employed and thus, FIG. 4, if an end view of the entire 1000 feet of horizontal borehole, would show 32 triangular shaped drill collar intermediate portions. Only four are shown for simplicity and to illustrate the principle that the triangular shaped drill collars align arbitrarily in the borehole or, if necessary, by intention, so that the drill collars are not in uniform cross-sectional alignment. This creates a torturous flow path for the drilling fluid circulating in the annular area exterior of the drill collars as it returns in the annular area to the earth's surface. The torturous flow path causes turbulent flow of the drilling fluid and this turbulence tends to carry drilling cuttings more effectively back to the earth's surface thereby reducing the possibility of the drill collars being stuck in the borehole.

As has been previously stated, a typical size of a borehole of an oil or gas well is 8½ inches. This is by way of example only and in which case it is suggested that the drill collar intermediate portion 10 provide a radius being typically of 4 inches, as seen in FIG. 2. However, this may vary considerably and the borehole size could be as little as 1 inch to greater than 24 inches.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved drill collar particularly for use in drilling horizontal holes employing a fluid driven drill, comprising:

an elongated intermediate portion of at least substantially triangular cross-sectional configuration and having a central passageway therethrough and having an externally threaded first and second end, the intermediate portion being formed of a lightweight metal selected from the group comprising aluminum, magnesium and alloys thereof;

a first tubular tool joint member having first and second internally threaded ends, the first threaded end being threadably secured to said intermediate portion first end; and a second tubular tool joint member having first and second ends, the first end being internally threaded and threadably secured to said intermediate portion second end, said second tool joint second end being externally threaded with a threading size and configuration matching said first tool joint member second end, said tool joint members being of a metal dissimilar to the metal of which said intermediate portion is formed.

2. An improved drill collar according to claim 1 wherein said intermediate portion has a cylindrical portion adjacent said externally threaded first end providing an area for receiving elevator attachment as said drill collar is run into or out of a borehole.

* * * * *